US006239091B1

(12) United States Patent
Tartakovsky et al.

(10) Patent No.: US 6,239,091 B1
(45) Date of Patent: May 29, 2001

(54) MACHINE DISHWASHING COMPOSITIONS WITH A POLYMER HAVING CATIONIC MONOMER UNITS

(75) Inventors: Alla Tartakovsky, West Orange; Joseph Oreste Carnali, Pompton Plains; John Robert Winters, Dumont, all of NJ (US)

(73) Assignee: Lever Brothers Company, division of Conopco, Inc., New York, NY (US)

( * ) Notice: Subject to any disclaimer, the term of this patent is extended or adjusted under 35 U.S.C. 154(b) by 0 days.

(21) Appl. No.: 09/075,548

(22) Filed: May 11, 1998

Related U.S. Application Data

(63) Continuation-in-part of application No. 08/898,758, filed on Jul. 23, 1997, now Pat. No. 5,981,456.

(51) Int. Cl.[7] ..... C11D 3/37; C11D 3/08

(52) U.S. Cl. ..... 510/220; 510/220; 510/223; 510/233; 510/288; 510/323; 510/349; 510/434; 510/441; 510/480; 510/504; 510/514

(58) Field of Search ..... 510/220, 223, 510/233, 288, 323, 349, 434, 441, 480, 514, 504

(56) References Cited

U.S. PATENT DOCUMENTS 5,476,660 * 12/1995 Somasundaran et al. ..... 424/401
5,567,428 * 10/1996 Hughes ..... 424/401
5,653,970 * 8/1997 Vermeer ..... 424/70.24

* cited by examiner

*Primary Examiner*—Yogendra N. Gupta
*Assistant Examiner*—Charles Boyer
(74) *Attorney, Agent, or Firm*—Edward A. Squillante, Jr.

(57) ABSTRACT

A detergent or rinse aid composition which reduces spotting and filming on glassware cleaned in an automatic dishwashing machine is described. The composition contains an effective amount of a water soluble cationic or amphoteric polymer having at least one monomer unit having a cationic charge over a portion of the pH range of about 2 to about 11 in the wash or rinse cycle.

7 Claims, No Drawings

MACHINE DISHWASHING COMPOSITIONS WITH A POLYMER HAVING CATIONIC MONOMER UNITS

RELATED APPLICATIONS

This is a continuation-in-part of Ser. No. 08/898,758 filed Jul. 23, 1997 now U.S. Pat. No. 5,981,456.

FIELD OF THE INVENTION

This invention relates to a nonchlorine containing machine dishwashing detergent or rinse aid formulation which delivers excellent final glassware appearance.

BACKGROUND OF THE INVENTION

Machine dishwashing detergents constitute a generally recognized distinct class of detergent compositions, particularly as compared to detergents designed for fabric laundering. As an example, a spotless and film-free appearance of glasses and silverware is the expected final result of a machine dishwashing run while, in many laundering operations, substances which may leave a greasy, oily or soapy residue can be tolerated.

In general, machine dishwashing detergents are mixtures of ingredients whose purpose, in combination, is to break down and remove food soils; to inhibit foaming caused by certain food soils; and to remove stains such as might be caused by beverages such as coffee and tea or by vegetable soils such as carotenoid soils. While necessary for these various cleaning benefits, machine dishwashing detergents can also create or exacerbate other problems. As an example, carbonate and phosphate salts, often detergent ingredients, are known to contribute to the formation of hard water films on glasses. In European applications, the water used to prepare the solution for the washing process is often treated (softened) to remove hardness ions such as calcium and magnesium with the result that hard water residues on washware are reduced. Nevertheless, spotting and filming from soil residues and precipitates from the detergent formulation can remain a problem, especially if the ion exchange unit serving the dishwashing machine is operating inefficiently.

Conventional machine dishwashing detergents employ strong alkalis such as sodium hydroxide, bleaches such as hypochlorite, and builders such as phosphates in order to assist in the cleaning steps outlined above. However, environmental factors, such as restrictions on phosphate and chlorine levels, and safety considerations have lead to the search for a new class of lower pH detergent formulations. Further, conventional formulations can damage items unique to machine dishwashing such as silverware, glassware and dishware. Certain of these items can be expensive to replace and force the consumer to separate them out from the rest of the table ware for hand washing—an obvious inconvenience. This new class of detergent formulations employs various detersive enzymes, including amylolytic and proteolytic enzymes, to compensate for the loss in cleaning effectiveness inherent at these lower pH values. Unfortunately, the conventional hypochlorite bleach system is incompatible with this enzymatic route and, as a consequence, oxygen bleaching systems have been adopted.

While the soil removal properties of these enzymatic formulations can match that of the conventional detergents, they have one notable weakness in the area of spotting and filming on glasses. The absence of chlorine bleach, alkalinity and phosphate builders generally results in higher spotting and filming scores under controlled laboratory testing and in a higher frequency of complaints from consumers in these two areas.

Spotting and filming of glassware are the chief criteria by which the performance of a dishwashing formulation is judged. Spotting is an obvious reference to discrete residues on glassware which have resulted when water droplets have completely evaporated and left behind any dissolved solids. Filming refers to a more uniform deposition over a large, contiguous portion of the glass surface. Without wishing to be bound by theory, it is believed that this film can sometimes be of organic origin (resulting from soil in the wash liquor) but is also often inorganic in nature, due to the formation of some mineral precipitate.

Accordingly, it is an object of the present invention to provide a new and improved machine dishwashing composition. Preferred compositions are free from chlorine bleach but may, optionally, contain an oxygen bleach. It is another object herein to provide dishwashing detergent compositions which contain effective levels of a cationic or amphoteric polymer which provides superior glassware appearance as evidenced by reduced spotting and filming. Another object herein is to provide a dishwashing rinse aid formulation containing an effective level of the cationic or amphoteric polymer.

DESCRIPTION OF THE PRIOR ART

Low molecular weight homopolymers of acrylic acid (such as Acusol 445, ex Rohm and Haas) discussed in Witak, D. et al. "Exploring Options for Dishwashing Detergents in the 1990s", HAPPI, August 1990, p. 64 may be used in combination with a reduced or zero level of a phosphate builder, to give a reduced film score on glasses.

A copolymer of maleic acid or maleic anhydride and a $C_{2-4}$ olefin comonomer is described as an additive for chlorine-free machine dishwashing detergent formulations in lieu of chlorine bleach in U.S. Pat. No. 5,232,622. This hydrophobically modified polyacrylate is also described as reducing the incidence of spot formation with a margarine/milk soil in a zero phosphate formulation in Shulman, J. E. "Non Phosphate ADDS", (July 1992) HAPPI, p. 130. Both spotting and filming are controlled by a combination of Acusol 460ND and either of Acusol 479N (a copolymer of acrylic acid and maleic acid) or Acusol 445. Such a combination of polyacrylates has also been described in U.S. Pat. No. 5,279,756.

Terpolymers of acrylic acid, acrylamide or butyl acrylate, and an aminoacryloyl derivative are disclosed as being useful at 0.5 to 7% levels in a machine dishwashing detergent formulation for reducing spotting and filming in the presence of a margarine/milk soil in U.S. Pat. No. 5,308,532. The performance of said terpolymers was found to surpass that of a 4500 MW homopolymer of acrylic acid (i.e. Acusol 445N, ex. Rohm and Haas). Similar claims are made for a copolymer of acrylic acid and the aminoacryloyl derivative in EP 0 560 519 A2.

Low molecular weight homopolymers of maleic acid are disclosed in U.S. Pat. No. 5,545,348 as being superior to copolymers of acrylic acid and maleic acid or to copolymers of maleic acid and an olefin comonomer with respect to reducing filming.

U.S. Patent No. 5,597,789 discloses a dishwashing composition comprising a mixture of disilicate and a low molecular weight, modified polyacrylate copolymer. The copolymer was described to reduce filming on glassware relative to acrylic acid/maleic acid copolymers of 70,000 MW or acrylic acid homopolymers of 4500 MW.

In summary, the prior art teaches the use of anionic, vinyl polymers consisting chiefly of acrylic acid or modified polyacrylates for the improvement of spotting and filming in chlorine-free machine dishwashing detergent formulations. However, the prior art does not suggest that cationic polymers reduce spotting and filming during machine dishwashing. Nor does it suggest that cellulosic materials, and especially cationically modified cellulose polymers, should offer any benefit in glass appearance.

SUMMARY OF THE INVENTION

It has now been discovered that a class of water soluble, cationic or amphoteric polymers provide enhanced appearance to glassware when incorporated in the dishwashing process as evidenced, in part, by a reduction of formation of spots and film on washed glass articles.

The present invention comprises incorporation of specific water soluble cationic or amphoteric polymers in the dishwashing process to improve the appearance of washed glass articles. The essential polymers in this invention may be incorporated at any point in the dishwashing process. The polymers may be incorporated into typical detergent or rinse aid formulations, or may be incorporated in any desired form such as tablets, powders, granulates, pastes, liquids, and gels.

DETAILED DESCRIPTION OF THE INVENTION

The present invention comprises incorporation of water soluble cationic or amphoteric polymers in the dishwashing process to improve the appearance of washed glass articles. The essential polymers in this invention may be incorporated at any point in the dishwashing process. The polymers may be incorporated into typical detergent or rinse aid formulations, or may be incorporated in any desired form such as tablets, powders, granulates, pastes, liquids, and gels.

Water Soluble Cationic or Amphoteric Polymer

A water soluble cationic or amphoteric polymer is here defined to include polymers which, because of their molecular weight or monomer composition, are soluble or dispersible to at least the extent of 0.01% by weight in distilled water at 25° C. Water soluble cationic or amphoteric polymers include polymers in which one or more of the constituent monomers are selected from the list of copolymerizable cationic monomers. These monomer units contain a positive charge over a portion of the pH range 2–11. A partial listing of such monomers is presented in "Water-Soluble Synthetic Polymers: Properties and Behavior, Volume II", by P. Molyneux, CRC Press, Boca Raton, 1983, ISBN 0-8493-6136-incorporated herein by reference. Additional monomers can be found in the "International Cosmetic Ingredient Dictionary, 5th Edition", edited by J. A. Wenninger and G. N. McEwen, The Cosmetic, Toiletry, and Fragrance Association, Washington, D.C., 1993, ISBN 1-882621-06-9, incorporated herein by reference. A third source of such monomers can be found in "Encyclopedia of Polymers and Thickeners for Cosmetics", by R. Y. Lochhead and W. R. Fron, Cosmetics & Toiletries, vol. 108, May 1993, pages 95–135, herein incorporated.

Specifically, monomers useful in this invention may be represented structurally as ethylenically unsaturated compounds as in formula I.

I

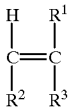

wherein $R^1$ is hydrogen, hydroxyl, or a $C_1$ to $C_{30}$ straight or branched alkyl radical; $R^2$ is hydrogen, or a $C_{1-30}$ straight or branched alkyl, a $C_{1-30}$ straight or branched alkyl substituted aryl, aryl substituted $C_{1-30}$ straight or branched alkyl radical, or a polyoxyalkene condensate of an aliphatic radical; and $R^3$ is a heteroatomic organic radical containing either one or more quaternized nitrogen atoms or one or more amine groups which possess a positive charge over a portion of the pH interval pH 2 to 11. For purposes of this invention the term "organic radical" means straight or branched saturated aliphatic, straight or branched unsaturated aliphatic or aromatic radical. Such amine groups can be further delineated as having a $PK_a$ of about 6 or greater, as defined by R. Laughlin in "Cationic Surfactants, Physical Chemistry", edited by D. N. Rubingh and P. M. Holland, Marcel Dekker, New York, 1991, ISBN 0-8247-8357-3.

Examples of cationic monomers of formula I include, but are not limited to, co-poly 2-vinyl pyridine and its co-poly 2-vinyl N-alkyl quaternary pyridinium salt derivatives; co-poly 4-vinyl pyridine and its co-poly 4-vinyl N-alkyl quaternary pyridinium salt derivatives; co-poly 4-vinylbenzyltrialkylammonium salts such as co-poly 4-vinylbenzyltrimethylammonium salt; co-poly 2-vinyl piperidine and co-poly 2-vinyl piperidinium salt; co-poly 4-vinylpiperidine and co-poly 4-vinyl piperidinium salt; co-poly 3-alkyl 1-vinyl imidazolinium salts such as co-poly 3-methyl 1-vinyl imidazolinium salt; acrylamido and methacrylamido derivatives such as co-poly dimethyl aminopropylmethacrylamide, co-poly acrylamidopropyl trimethylammonium salt and co-poly methacrylamidopropyl trimethylammonium salt; acrylate and methacrylate derivatives such as co-poly dimethyl aminoethyl (meth)acrylate, co-poly ethanaminium N,N,N trimethyl 2-[(1-oxo-2 propenyl) oxy]-salt, co-poly ethanaminium N,N,N trimethyl 2-[(2 methyl-1-oxo-2 propenyl) oxy]-salt, and co-poly ethanaminium N,N,N ethyl dimethyl 2-[(2 methyl-1-oxo-2 propenyl) oxy]-salt.

Also included among the cationic monomers suitable for this invention are co-poly vinyl amine and co-polyvinylammonium salt; co-poly diallylamine, co-poly methyidiallylamine, and co-poly diallyidimethylammonium salt; and the ionene class of internal cationic monomers as defined by D. R. Berger in "Cationic Surfactants, Organic Chemistry", edited by J. M. Richmond, Marcel Dekker, New York, 1990, ISBN 0-8247-8381-6, herein incorporated by reference. This class includes co-poly ethylene imine , co-poly ethoxylated ethylene imine and co-poly quaternized ethoxylated ethylene imine; co-poly [(dimethylimino) trimethylene (dimethylimino) hexamethylene disalt], co-poly [(diethylimino) trimethylene (dimethylimino) trimethylene disalt]; co-poly [(dimethylimino) 2-hydroxypropyl salt]; co-polyquaternium-2, co-polyquaternium-17, and co-polyquaternium 18, as defined in the "International Cosmetic Ingredient Dictionary, 5th Edition", edited by J. A. Wenninger and G. N. McEwen.

Additionally, useful polymers are the cationic co-poly amido-amine having the chemical structure of formula II.

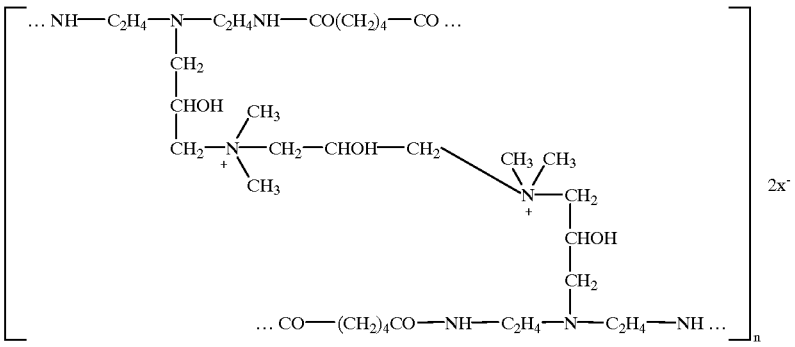

II and the quaternized polyimidazoline having the chemical structure of formula III

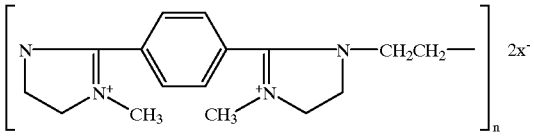

III wherein n is 1 to 100,000 and x is chosen from the halides: chloride, bromide, and iodide; or from hydroxide, phosphate, sulfate, hydrosulfate, ethyl sulfate, methyl sulfate, formate, and acetate.

An additional class of cationic monomers suitable for this invention are those arising from natural sources and include, but are not limited to, cocodimethylammonium hydroxypropyl oxyethyl cellulose, lauryldimethylammonium hydroxypropyl oxyethyl cellulose, stearyidimethylammonium hydroxypropyl oxyethyl cellulose, and stearyidimethylammonium hydroxyethyl cellulose; guar 2-hydroxy-3-(trimethylammonium) propyl ether salt; cellulose 2-hydroxyethyl 2-hydroxy 3-(trimethyl ammonio) propyl ether salt.

It is likewise envisioned that monomers containing cationic sulfonium salts such as co-poly 1-[3-methyl4-(vinylbenzyloxy)phenyl] tetrahydrothiophenium chloride would also be applicable to the present invention.

Preferred cationic monomers are diallyldimethylammonium salts, having the chemical structure as unpolymerized or polymerized monomer, respectively, of formula IVa or Ivb.

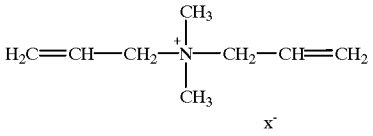

IVa or

-continued

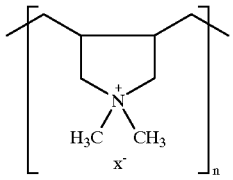

IVb wherein n is 1 to 100,000 and x is chosen from the halides: chloride, bromide, and iodide; or from hydroxide, phosphate, sulfate, hydrosulfate, ethyl sulfate, methyl sulfate, formate, and acetate.

Water soluble amphoteric polymers suitable for incorporation into the present invention can also include polymers in which one or more of the constituent monomers are selected from the list of copolymerizable, internally amphoteric monomers. These monomer units contain both one or more positive charges and one or more negative charges over a portion of the pH range 2–11. Such internally amphoteric monomers include those species possessing formal anionic and cationic charges such as N,N-dimethyl, N-acetyl aminoethylmethacrylate. Also included are monomers which, while not possessing formal charges, have one or more resonance forms which result in the occurrence of fractional cationic and anionic charges being separated within the monomer. Monomers in this class are typified by vinyl pyrrolidone, as described in "Water-Soluble Synthetic Polymers: Properties and Behavior, Volume I", by P. Molyneux, CRC Press, Boca Raton, 1983, ISBN 0-8493-6135-4, incorporated herein by reference. Further examples include vinyl oxazolidone; vinyl methoxazolidone; and vinyl caprolactam.

The mole fraction of the cationic or amphoteric polymer which is composed of the above-described cationic or amphoteric monomer units can range from 1 to 100%, preferably from 1 to 50%, and most preferably from 2 to 20% of the entire polymer. The remaining monomer units comprising the cationic or amphoteric polymer are chosen from the class of anionic monomers and the class of nonionic monomers or solely from the class of nonionic monomers. In the former case, the polymer is an amphoteric polymer while in the latter case it can be a cationic polymer, provided that no amphoteric co-monomers are present.

The anionic monomers comprise a class of monounsaturated compounds which possess a negative charge over the portion of the pH range from pH 2 to 11 in which the cationic monomers possess a positive charge. The nonionic monomers comprise a class of monounsaturated compounds which are uncharged over the pH range from pH 2 to 11 in which the cationic monomers possess a positive charge A suitable class of both the anionic and the nonionic monomers are the vinyl (ethylenically unsaturated) substituted compounds corresponding to formula V.

V

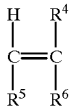

wherein $R^4$, $R^5$, and $R^6$ are independently hydrogen, a $C_1$ to $C_3$ alkyl, a carboxylate group or a carboxylate group substituted with a $C_1$ to $C_{30}$ linear or branched heteroatomic alkyl or aromatic radical, a heteroatomic radical or a poly oxyalkene condensate of an aliphatic radical.

The class of anionic monomers are represented by the compound described by formula V in which at least one of the $R^4$, $R^5$, or $R^6$ comprises a carboxylate, substituted carboxylate, phosphonate, substituted phosphonate, sulfate, substituted sulfate, sulfonate, or substituted sulfonate group. Preferred monomers in this class include but are not limited to α-ethacrylic acid, α-cyano acrylic acid, β,β-dimethacrylic acid, methylenemalonic acid, vinylacetic acid, allylacetic acid, acrylic acid, ethylidineacetic acid, propylidineacetic acid, crotonic acid, methacrylic acid, maleic acid, fumaric acid, itaconic acid, sorbic acid, angelic acid, cinnamic acid, β-styryl acrylic acid (1-carboxy4-phenyl butadiene-1,3), citraconic acid, glutaconic acid, aconitic acid, α-phenylacrylic acid, β-acryloxy propionic acid, citraconic acid, vinyl benzoic acid, N-vinyl succinamidic acid, and mesaconic acid. Also included in the list of preferred monomers are co-poly styrene sulfonic acid, 2-methacryloyloxymethane-1-sulfonic acid, 3-methacryloyloxypropane-1 -sulfonic acid, 3-(vinyloxy)propane-1 -sulfonic acid, ethylenesulfonic acid, vinyl sulfuric acid, 4-vinylphenyl sulfuric acid, ethylene phosphonic acid and vinyl phosphoric acid. Most preferred anionic monomers include acrylic acid, methacrylic acid and maleic acid. The polymers useful in this invention may contain the above monomers and the alkali metal, alkaline earth metal, and ammonium salts thereof.

A suitable class of nonionic monomers are represented by the compounds of formula V in which none of the $R^4$, $R^5$, or $R^6$ contain the above mentioned negative charge containing radicals. Suitable monomers in this class include, but are not limited to, vinyl alcohol; vinyl acetate; vinyl methyl ether; vinyl ethyl ether; acrylamide, methacrylamide and other modified acrylamides; vinyl propionate; alkyl acrylates (esters of acrylic or methacrylic acid); and hydroxyalkyl acrylate esters. A second class of nonionic monomers include co-poly ethylene oxide, co-poly propylene oxide, and co-poly oxymethylene.

Another class of suitable nonionic monomers includes naturally derived materials such as celluloses and starches. A most preferred nonionic monomer is hydroxyethylcellulose, with the chemical structure illustrated in formula VI.

VI

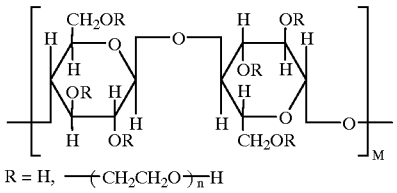

wherein M is 1 to 100,000 and n is 1 to 15.

The average molecular weight of the polymers of this invention range from about 1000 to about $10^7$, with the preferred molecular weight range depending on the polymer composition.

A particularly useful class of cationic polymers in this invention are copolymers of diallyldimethylammonium salt and hydroxyethylcellulose, designated by the Cosmetic, Toiletry, and Fragrance Association as "Polyquaternium 4". Preferred examples are materials supplied commercially by the National Starch and Chemicals Company under the trade names Celquat L-200 and Celquat H-100. A sample of L-200 had a composition of 45/155 diallyldimethylammonium chloride/hydroxyethylcellulose, while a sample of H-100 was composed of 11/89 diallyldimethylammonium chloride/hydroxyethylcellulose, when characterized by NMR (mole fractions). Both polymer samples have molecular weights greater than 1,000,000 as determined by gel permeation chromatography.

It is understood that the polymers in this invention may be incorporated into the dishwasher at any point in the wash process. An effective amount of said polymer is 0.025 to 5.00 grams, preferably 0.1 to 3.00 grams, most preferably 0.2 to 2.50 grams per wash cycle, all by weight. If the polymer is incorporated into a typical concentrated detergent formulation, this effective amount is equivalent to a polymer concentration of 0.1 to 20.0%, preferably 0.4 to 12.0%, and most preferably 0.8 to 10.0% by weight of the formulation. In a typical rinse aid composition, this effective amount is equivalent to a polymer concentration of 0.5 to 90.0%, preferably 2.0 to 60.0%, and most preferably 4.0 to 50.0% by weight of the formulation.

Detergent and Rinse Aid Compositions

Typical detergent compositions may comprise builders and other optional components. Rinse aid compositions typically comprise an aqueous liquid containing surfactants, hydrotropes, an ingredient such as citric acid that can act as a builder and pH control agent, and other optional components. Thus, the essential polymeric ingredients herein described above may be incorporated into the dishwashing process in conjunction with conventional ingredients, preferably selected from builders, enzymes, buffering systems, oxygen bleaching systems, surfactants, heavy metal ion sequestrants, antiscalants, corrosion inhibitors, antifoams, lime soap dispersant compounds, solvents, and hydrotropes.

A typical aqueous rinse aid composition would be

| | Wt. % |
|---|---|
| Nonionic surfactant | 1–40 |
| Builder/pH adjuster agent | 1–60 |
| Hydrotrope (optional) | 1–20 |
| Water | Balance |

Phosphate Builder

The compositions of the present invention which utilize a water-soluble phosphate builder typically contain this builder at a level of from 1 to 90% by weight, preferably from 10 to 80% by weight, most preferably from 20 to 70% by weight of the composition. Specific examples of water-soluble phosphate builders are the alkali metal tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Nonphosphate Builder

The compositions of the present invention which utilize a water-soluble nonphosphate builder typically contain this builder at a level of from 1 to 90% by weight, preferably from 10 to 80% by weight, most preferably from 20 to 70% by weight of the composition. Suitable examples of non-phosphorus-containing inorganic builders include water-soluble alkali metal carbonates, bicarbonates, sesquicarbonates, borates, silicates, including layered silicates such as SKS-6 ex. Hoechst, metasilicates, and crystalline and amorphous aluminosilicates. Specific examples include sodium carbonate (with or without calcite seeds), potassium carbonate, sodium and potassium bicarbonates, silicates including layered silicates and zeolites.

Organic detergent builders can also be used as nonphosphate builders in the present invention. Examples of organic builders include alkali metal citrates, succinates, malonates, fatty acid sulfonates, fatty acid carboxylates, nitrilotriacetates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleatelvinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062. Alkali metal citrates, nitrilotriacetates, oxydisuccinates, acrylate/maleate copolymers and acrylatelmaleatelvinyl alcohol terpolymers are especially preferred nonphosphate builders.

Enzymes

Enzymes capable of facilitating the removal of soils from a substrate may also be present in a combined amount of up to about 10% by weight of active enzyme. Such enzymes include proteases, amylases, lipases, esterases, cellulases, pectinases, lactases and peroxidases as conventionally incorporated into dishwashing compositions.

Preferred commercially available protease enzymes include those sold under the tradenames Alcalase, Savinase, Durazyme, Esperase and Everlase from Novo Industries A/S (Denmark); and those sold by Genencor International under the tradenames Maxacal, Purafect OxP and Properase. Preferred commercially available amylases include those α-amylases sold under the tradenames Termamyl, Duramyl and BAN from Novo Industries and those sold by Genencor International under the tradenames Maxamyl, Purafect OxAm and Purafect HpAm. Preferred commercially available lipases include Lipolase and Lipolase Ultra from Novo Industries and Lipomax sold by Genencor International.

Buffering System

When the essential polymers of the invention are incorporated in detergent or rinse aid compositions, the pH of the compositions may optionally be adjusted by the use of various pH adjusting agents.

For detergent compositions, a buffering system may be present in order to deliver a pH of about 6 to about 11 in the wash water. Materials which may be selected for the buffering system include water-soluble alkali metal carbonates, bicarbonates, sesquicarbonates, borates, silicates, layered silicates such as SKS-6 ex Hoechst, metasilicates, phytic acid, citric acid, borate and crystalline and amorphous aluminosilicates and mixtures thereof. Preferred examples include sodium and potassium carbonate, sodium and potassium bicarbonates, borates and silicates, including layered silicates.

Alternatively, if the essential polymers of the invention are incorporated into rinse aid formulations the pH of typical rinse aid compositions are in the range of 0.5 to 6.5 when measured as 1% solutions. Thus the pH of rinse aid compositions may optionally be adjusted by the use of various acidifying pH adjusting agents. Preferred acidification agents include inorganic and organic acids including, for example, carboxylic acids, such as citric and succinic acids, polycarboxylic acids, such as polyacrylic acid, and also acetic acid, boric acid, malonic acid, adipic acid, fumaric acid, lactic acid, glycolic acid, tartaric acid, tartronic acid, malic acid, their derivatives and any mixtures of the foregoing.

Oxygen Bleaching Systems

The present invention may optionally contain an oxygen bleach source chosen from the following:

Peroxy Bleaching Agents—The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoic acid, and magnesium monoperoxyphthalate ii) aliphatic and substituted aliphatic monoperoxy acids, e.g., peroxylauric acid, peroxystearic acid, epsilon-phthalimido-peroxyhexanoic acid and o-carboxybenzamido peroxyhexanoic acid, N-nonylamidoperadipic acid and N-nonylamidopersuccinic acid.

iii) Cationic peroxyacids such as those described in U.S. Pat. No. 5,422,028, 5,294,362; and 5,292,447, Oakes et al., U.S. Ser. No. 08/738,504; and U.S. Ser. No. 08/210, 973, Oakes et al., herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxy-isophthalic acid viii) 2-decyldiperoxybutan-1,4-dioic acid ix) $N,N^1$-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred peroxy bleaching agents include salts of perborate monohydrate, perborate tetrahydrate, percarbonate and monopersulfate, epsilon-phthalimido-peroxyhexanoic acid, o-carboxybenzamidoperoxyhexanoic acid, and mixtures thereof.

The organic peroxy acid is present in the composition in an amount such that the level of organic peroxy acid in the wash solution is about 1 ppm to about 300 ppm AvOx, preferably about 2 ppm to about 200 ppm AvOx.

The oxygen bleaching agent may be incorporated directly into the formulation or may be encapsulated by any number of encapsulation techniques.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

Bleach Precursors—Suitable peracid precursors for peroxy bleach compounds have been amply described in the literature, including GB Nos. 836,988; 855,735; 907,356; 907;358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzene-sulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

The peroxygen bleach precursors are present in the composition in an amount from about 1 to about 20 weight percent, preferably from about 1 to about 15 wt. %, most preferably from about 2 to about 15 wt. %. To deliver a functional peroxygen bleach from a precursor, a source of hydrogen peroxide is required. The hydrogen peroxide source is preferably a compound that delivers hydrogen peroxide on dissolution. Preferred sources of hydrogen peroxide are sodium perborate, either as the mono- or tetrahydrate and sodium percarbonate. The source of hydrogen peroxide, when included in these compositions is present at a level of about 1% to about 40% by weight, preferably from about 2% to about 30% by weight, most preferably from about 4% to about 25% by weight.

Bleach Catalyst—An effective amount of a bleach catalyst can also be present in the invention. A number of organic catalysts are available such as the sulfonimines as described in U.S. Pat. Nos. 5,041,232; 5,047,163 and 5,463,115.

Transition metal bleach catalysts are also useful, especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

Suitable examples of manganese catalysts containing organic ligands are described in U.S. Pat. No. 4,728,455, U.S. Pat. No. 5,114,606, U.S. Pat. No. 5,153,161, U.S. Pat. No. 5,194,416, U.S. Pat. No. 5,227,084, U.S. Pat. No. 5,244,594, U.S. Pat.5,246,612, U.S. Pat. No. 5,246,621, U.S. Pat. No. 5,256,779, U.S. Pat. No. 5,274,147, U.S. Pat. No. 5,280,117 and European Pat. No. App. Pub. Nos. 544,440, 544,490, 549,271 and 549,272. Preferred examples of these catalysts include $Mn^{IV}_2(u\text{-}O)_2(1,4,7\text{-trimethyl-}1,4,7\text{-triazacyclononane})_2(PF_6)_2$, $Mn^{III}_2(u\text{-}O)_1(u\text{-}OAc)_2(1,4,7\text{-trimethyl-}1,4,7\text{-triazacyclononane})_2(ClO_4)_2$, $Mn^{IV}_4(u\text{-}O)_6(1,4,7\text{-triazacyclononane})_4(ClO_4)_4$, $Mn^{III}Mn^{IV}_4(u\text{-}O)_1(u\text{-}OAc)_2(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606, is a water soluble complex of manganese (II), (III), and/or (IV) with a ligand which is a non-carboxylate polyhydroxy compound having at least three consecutive C-OH groups. Preferred ligands include sorbitol, iditol, dulsitol, mannitol, xylitol, arabitol, adonitol, meso-erythritol, meso-inositol, lactose and mixtures thereof. Especially preferred is sorbitol.

U.S. Pat. No. 5,114,611 teaches a bleach catalyst comprising a complex of transition metals, including manganese, cobalt, iron or copper with a non-(macro)-cyclic ligand. Other examples include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2](ClO_4)_3$.

Other bleach catalysts are described, for example, in European Pat. No. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (Chelants with manganese cations and non-catalytic metal cations), and U.S. Pat. No. 4,728,455 (manganese gluconates).

Useful catalysts based on cobalt are described in Pat. No. App. Pub. Nos. WO 96/23859, WO 96/23860 and WO 96/23861 and U.S. Pat. No. 5,559,261. WO 96/23860 describe cobalt catalysts of the type $[Co_nL_mX_p]^zY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis(salicylidene)ethylenediaminecobalt (II). Other cobalt catalysts described in these applications are based on Co(III) complexes with ammonia and mon-, bi-, tri- and tetradentate ligands such as $[Co(NH_3)_5OAc]^{2+}$ with $Cl^-$, $OAc^-$, $PF_6^-$, $SO_4^=$, and $BF_4^-$ anions.

Certain transition-metal containing bleach catalysts can be prepared in the situ by the reaction of a transition-metal salt with a suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Surfactants

Optionally, a surfactant selected from the list including anionic, nonionic, cationic, amphoteric, and zwifterionic surfactants and mixtures of these surface active agents may be included in a composition containing the essential polymers. Such surfactants are well known in the detergent arts and are described at length in "Surface Active Agents and Detergents", Vol. 2 by Schwartz, Perry and Birch, Interscience Publishers, Inc., 1959, herein incorporated by reference. Low foaming surfactants are most suitable for machine dishwashing applications.

Preferred surfactants are one or a mixture of:

Anionic surfactants—Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^7OSO_3M$$

where $R^7$ is a primary alkyl group of 8 to 18 carbon atoms and M is a solubilizing cation. The alkyl group $R^7$ may have a mixture of chain lengths. It is preferred that at least two-thirds of the $R^7$ alkyl groups have a chain length of 8 to 14 carbon atoms. This will be the case if $R^7$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl Ether Sulfates $$R^7O(CH_2CH_2O)_nSO_3M$$

where $R^7$ is a primary alkyl group of 8 to 18 carbon atoms, n has an average value in the range from 1 to 6 and M is a solubilizing cation. The alkyl group $R^7$ may have a mixture of chain lengths. It is preferred that at least two-thirds of the $R^7$ alkyl groups have a chain length of 8 to 14 carbon atoms. This will be the case if $R^7$ is coconut alkyl, for example. Preferably n has an average value of 2 to 5.

Fatty Acid Ester Sulfonates $$R^8CH(SO_3M)CO_2R^9$$

where $R^8$ is an alkyl group of 6 to 16 atoms, $R^9$ is an alkyl group of 1 to 4 carbon atoms and M is a solubilizing cation. The group $R^8$ may have a mixture of chain lengths. Preferably at least two-thirds of these groups have 6 to 12 carbon atoms. This will be the case when the moiety $R^8CH(-)CO_2(-)$ is derived from a coconut source, for instance. It is preferred that $R^9$ is a straight chain alkyl, notably methyl or ethyl.

Alkyl Benzene Sulfonates $$R^{10}ArSO_3M$$

where $R^{10}$ is an alkyl group of 8 to 18 carbon atoms, Ar is a benzene ring ($C_6H_4$) and M is a solubilizing cation. The group $R^{10}$ may be a mixture of chain lengths. Straight chains of 11 to 14 carbon atoms are preferred.

Paraffin sulfonates having 8 to 22 carbon atoms, preferably 12 to 16 carbon atoms, in the alkyl moiety. These surfactants are commercially available as Hostapur SAS from Hoechst Celanese.

Olefin sulfonates having 8 to 22 carbon atoms, preferably 12 to 16 carbon atoms. U.S. Pat. No. 3,332,880 contains a description of suitable olefin sulfonates.

Organic phosphate based anionic surfactants include organic phosphate esters such as complex mono- or diester phosphates of hydroxyl- terminated alkoxide condensates, or salts thereof. included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^8CH(SO_3M)CO_2R^9$$

where the moiety $R^8CH(-)CO_2(-)$ is derived from a coconut source and $R^9$ is either methyl or ethyl; primary alkyl sulfates with the formula:

$$R^7OSO_3M$$

wherein $R^7$ is a primary alkyl group of 10 to 18 carbon atoms and M is a sodium cation; and paraffin sulfonates, preferably with 12 to 16 carbon atoms to the alkyl moiety.

Nonionic surfactants—Nonionic surfactants can be broadly defined as surface active compounds with one or more uncharged hydrophilic substituents. A major class of nonionic surfactants consists of those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

Polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, Polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^{11}$ in the general formula:

$$R^{11}O(CH_2CH_2)_nH$$

is from 6 to 20 carbon atoms. Notably the group $R^{11}$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^{11}$ which has 9 to 18 carbon atoms while n is from 2 to 8.

Also included within this category are nonionic surfactants having a formula:

$$R^{12}—(CH_2\underset{\underset{R^{13}}{|}}{C}HO)_x(CH_2CH_2O)_y(CH_2\underset{\underset{R^{14}}{|}}{C}HO)_zH$$

wherein $R^{12}$ is a linear alkyl hydrocarbon radical having an average of 6 to 18 carbon atoms, $R^{13}$ and $R^{14}$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18, a registered trademark of the Olin Corporation, New Haven, Conn., having a composition of the above formula where $R^{12}$ is a $C_6$–$C_{10}$ linear alkyl mixture, $R^{13}$ and $R^{14}$ are methyl, x averages 3, y averages 12 and z averages 16. Another preferred nonionic surfactant is:

$$R^{15}—O—(CH_2\underset{\underset{CH_3}{|}}{C}HO)_j(CH_2CH_2O)_k(CH_2)OH)R^{16})_l$$

wherein $R^{15}$ is a linear, aliphatic hydrocarbon radical having from about 4 to about 18 carbon atoms including mixtures thereof; and $R^{16}$ is a linear, aliphatic hydrocarbon radical having from about 2 to about 26 carbon atoms including mixtures thereof; j is an integer having a value of from 1 to about 3; k is an integer having a value from 5 to about 30; and I is an integer having a value of from 1 to about 3. Most preferred are compositions in which j is 1, k is from about 10 to about 20 and I is 1. These surfactants are described in WO 94/22800. Other preferred nonionic surfactants are linear fatty alcohol alkoxylates with a capped terminal group, as described in U.S. Pat. No. No. 4,340,766 to BASF. Particularly preferred is Plurafac LF403 ex. BASF.

Another nonionic surfactant included within this category are compounds of formula:

$$R^{17}—(CH_2CH_2O)_qH$$

wherein $R^{17}$ is a $C_6$–$C_{24}$ linear or branched alkyl hydrocarbon radical and q is a number from 2 to 50; more preferably $R^{17}$ is a $C_8$–$C_{18}$ linear alkyl mixture and q is a number from 2 to 15.

Polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide.

Polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters.

Polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine oxides having formula:

$$R^{18}R^{19}R^{20}N{=}O$$

wherein $R^{18}$, $R^{19}$ and $R^{20}$ are saturated aliphatic radicals or substituted saturated aliphatic radicals. Preferable amine oxides are those wherein R18 is an alkyl chain of about 10 to about 20 carbon atoms and $R^{19}$ and $R^{20}$ are methyl or ethyl groups or both $R^{18}$ and $R^{19}$ are alkyl chains of about 6 to about 14 carbon atoms and $R^{20}$ is a methyl or ethyl group.

Amphoteric synthetic detergents—can be broadly described as derivatives of aliphatic tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents—can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{21}O(R^{22}O)_n(Z^1)_p$$

wherein R21 is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{22}$ is a divalent hydrocarbon radical containing from 2 to about 4 carbon atoms such as ethylene, propylene or butylene (most preferably the unit $(R^{22}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG 300, 325 and 350 with $R^{21}$ being $C_9$–$C_{11}$, n is 0 and p is 1.3, 1.6 and 1.8–2.2 respectively; APG 500 and 550 with $R^{21}$ is $C_{12}$–$C_{13}$, n is 0 and p is 1.3 and 1.8–2.2, respectively; and APG 600 with $R^{21}$ being $C_{12}$–$C_{14}$, n is 0 and p is 1.3.

While esters of glucose are contemplated especially, it is envisaged that corresponding materials based on other reducing sugars, such as galactose and mannose are also suitable.

Particularly preferred nonionic surfactants are polyoxyethylene and polyoxypropylene condensates of linear aliphatic alcohols.

The preferred range of surfactant is from about 0.5 to 30% by wt., more preferably from about 0.5 to 15% by weight of the composition.

Sequestrants

The detergent compositions herein may also optionally contain one or more transition metal chelating agents. These components may also have calcium and magnesium chelation capacity, but preferentially they show selectivity to binding heavy metal ions. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 5.0% by weight of such composition.

Anti-Scalants

Scale formation on dishes and machine parts can be a significant problem. It can arise from a number of sources but, primarily it results from precipitation of either alkaline earth metal carbonates, phosphates or silicates. Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan CP5 and CP7 supplied by BASF or Acusol 479N supplied by Rohm & Haas; with methacrylic acid such as Colloid 226/35 supplied by Rhone-Poulenc; with phosphonate such as Casi 773 supplied by Buckman Laboratories; with maleic acid and vinyl acetate such as polymers supplied by Hüls; with acrylamide; with sulfophenol methallyl ether such as Aquatreat AR 540 supplied by Alco; with 2-acrylamido-2-methylpropane sulfonic acid such as Acumer 3100 supplied by Rohm & Haas or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcoperse 240 supplied by Alco; polymaleates such as Belclene 200 supplied by FMC; polymethacrylates such as Tamol 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-scalant, if present, is included in the composition from about 0.05% to about 10% by weight, preferably from 0.1% to about 5% by weight, most preferably from about 0.2% to about 5% by weight.

It should be noted that some antiscalant polymers, notably polyacrylates, are claimed as providing some glassware appearance benefit. The essential polymers of this invention are notable in that they provide a marked improvement in glassware appearance for systems which contain antiscalant polymers.

Corrosion Inhibitors

The composition my optionally contain corrosion inhibitors to reduce the tarnishing of silver flatware. Such inhibitors include benzotriazole and other members of the azole family. Particularly preferred azoles, including imidazoles, are described in Gary et al., U.S. Pat. No. 5,480,576, incorporated herein by reference. Additional antitarnish additives include water-soluble bismuth compounds such as bismuth nitrate as taught in GB 2,297,096 A; heavy metal salts of copper, iron, manganese, zinc, or titanium (EP 0 636 688 A1, GB 2,283,494 A); paraffin oil; and non-paraffin oil organic agents such as fatty esters of mono or polyhydric alcohols as claimed in EP 0 690 122 A2.

Antifoams

The compositions of the present invention, when formulated for use in machine dishwashing compositions, preferably comprise an antifoam system. Suitable antifoam systems for use herein may comprise essentially any known antifoam compound, including, for example, silicone antifoams, silicone oil, mono- and distearyl acid phosphates, mineral oil, and 2-alkyl and alcanol antifoam compounds. Even if the machine dishwashing composition contains only low foaming surfactants, the antifoam assists to minimize foam which food soils can generate. The compositions may include 0.02 to 2% by weight of antifoam, preferably, 0.05 to 1.0%. Preferred antifoam systems are described in Angevaare et al.; U.S. Ser. No. 08/539,923, incorporated herein by reference.

Lime Soap Dispersant Compound

The compositions of the invention may contain a lime soap dispersant compound, which has a lime soap dispersing power (LSDP), as defined hereinafter, of no more than 8, preferably no more than 7, most preferably no more than 6. The lime soap dispersant compound is preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to, for example, in the following review articles; W. N. Linfield, Surfactant Science Series, Volume 7, p 3; W. N. Linfield, Tenside Surf. Det., Volume 27, pages 159–161, (1990); and M. K. Nagarajan, W. F. Maslar, Cosmetics and Toiletries, Volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCO_3$ (Ca:Mg=3:2) equivalent hardness.

Surfactants having good lime soap dispersant capability will include certain amine oxides, betaines, sulfobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4) and the $C_{13}$–$C_{15}$ ethoxylated alcohols with an average degree of ethoxylation of either 12(LSDP=6) or 30, sold under the trade names Lutensol A012 and Lutensol A030 respectively, by BASF GmbH.

Solvent

The compositions of the invention may contain organic solvents, particularly when formulated as nonaqueous liquids or gels. The compositions in accord with the invention preferably contain a solvent system present at levels of from about 1% to about 30% by weight, preferably from about 3% to 25% by weight, more preferably form about 5% to about 20% by weight of the composition. The solvent system may be a mono or mixed solvent system. Preferably, at least the major component of the solvent system is of low volatility.

Suitable organic solvent for use herein has the general formula $RO(CH_2C(Me)HO)_nH$, wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1 -n-butoxypropane-2-ol(n=1): and 1(2-n-butoxy-1-methylethoxy)propane-2-ol (n=2), and mixtures thereof.

Other solvents useful herein include the water soluble CARBITOL® solvents or water-soluble CELLOSOLVE® solvents. Water-soluble CARBITOL® solvents are compounds of the 2-(2 alkoxyethoxy)ethanol class wherein the alkoxy group is derived from ethyl, propyl or butyl; a preferred water-soluble carbitol is 2(2-butoxyethoxy) ethanol also known as butyl carbitol. Water-soluble CELLOSOLVE® solvents are compounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethyl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (eg: ethanol, propanol, isopropanol, butanol and mixtures thereof) are preferred, with ethanol particularly preferred. The $C_1$–$C_4$ dihydric alcohols, including propylene glycol, are also preferred.

Hydrotropes

When the essential polymers of this invention are incorporated into rinse aid compositions, these compositions may also contain water. The compositions of the invention may contain hydrotropes, particularly when formulated as aqueous liquids or gels. The hydrotrope is typically present at levels of from about 0.5% to about 20%, preferably from about 1% to about 10%, by weight.

Useful hydrotropes include sodium, potassium, and ammonium xylene sulfonates, sodium, potassium, and ammonium toluene sulfonate, sodium, potassium and ammonium cumene sulfonate, and mixtures thereof.

The following examples will help to distinguish this invention from the prior art and illustrate its embodiment more fully. Unless indicated otherwise, all parts, percentages and portions referred to are by weight.

EXAMPLE 1

This example demonstrates the superior performance of the essential polymers of this invention when compared to commercially available polymers claimed to improve glassware appearance during the automatic dishwashing process. Machine dishwashing detergent formulations used for all examples were prepared as described in Table 1. Product 1 is a granular automatic dishwashing detergent based on a non-phosphate builder while Product 2 is a phosphate-built tablet.

TABLE 1

Formulations used in the examples

| Ingredients | Product 1 | Product 2 |
|---|---|---|
| Sodium tripolyphosphate | | 50.60 |
| Tri-sodium citrate dihydrate | 36.45 | |
| Acrylate homopolymer[1] | 1.95 | 3.30 |
| Acrylate/maleate copolymer[2] | 3.90 | |
| Sodium silicate | 1.95 | |
| Amorphous sodium silicate ($SiO_2$:$Na_2O$ = 2) | | 29.34 |
| Sodium bicarbonate | 15.80 | |
| Sodium perborate monohydrate | 15.75 | 9.00 |
| Tetraacetyl ethylene diamine - 83% | 2.75 | 2.40 |
| Anionic[3] | 12.40 | |
| Nonionic[4] | | 1.00 |
| Enzymes | 7.30 | 3.06 |
| 1, 2, 3 Benzotriazole | | 0.05 |
| Solid ketone particles dispersed in an organic carrier[5] | 1.35 | |
| Polybutadiene[6] | 0.45 | |
| Sodium hydroxyethane diphosphonic acid[7] | | 1.10 |

[1]Sokalan PA25 ex BASF
[2]Sokalan CP5 ex BASF
[3]Alpha Step ML 40 ex Henkel
[4]LF 403 ex BASF
[5]Dehypon 2429 ex Henkel
[6]ex Elf Atochem
[7]Dequest 2016 ex Monsanto 10 clean glasses were placed on the upper rack of an Electrolux ESF 675 automatic dishwasher. 40.0 g ASTM Standard Food Soil, described in section 5.2 of ASTM Method D 3556-85, "Standard Test Method for Deposition on Glassware During Mechanical Dishwashing", was spread on the dishwasher door. The soil consists of 80.0% margarine and 20.0% low fat powdered milk. Along with the ASTM soil, 10 egg yolk soiled plates and 10 starch soiled plates were placed on the bottom rack of the dishwasher. A Normal wash program consisted of a cold prewash, 65° C. main wash followed by two cold rinses, and a heated (to 65° C.) final rinse with a non-heated dry cycle. Water was adjusted to 500 ppm hardness (expressed as $CaCO_3$) with a Ca:Mg ratio of 4:1. Product 1 was used for both tests described in this example. In Test 1, 19.0 g of Product 1 was dosed via the dispenser cup of the automatic dishwasher together with 0.95 g of polymer. In Test 2, detergent was dosed via the dispenser cup while 0.3 g of the polymer was dosed directly into the machine at the beginning of the final rinse. After completion of the wash program, the appearance of the washed glassware was assessed visually using a light box as described in section 4.4 of ASTM Method D 3556-85. The light box is essentially a darkened room with the glasses being placed on racks and illuminated from within to disclose spots or film. All interior surfaces of the light box are black, so that the only light present is that which passes up through the tumblers. Washed glasses were scored using a 0–5 scale in which 0 is clean and 5 is completely covered with spots or heavy chalky film, respectively. The rating scale is described further in section 6.6 of ASTM Method D-3556-85. Results are recorded in Table 2.

TABLE 2

Effect of polymeric additives on glass appearance.

| | Test 1 | | Test 2 | |
|---|---|---|---|---|
| Polymers used | Spots | Film | Spots | Film |
| Control (no additive) | 4.1 | 1.2 | 4.1 | 1.2 |
| Co-polymer of diallyldimethyl ammonium chloride and hydroxyethylcellulose[1] (Polyquaternium 4) | 1.4 | 0.8 | 1.1 | 1.2 |
| Co-polymer of acrylic acid and acrylamidopropyltrimethyl ammonium chloride[2] | 3.2 | 0.8 | 3.8 | 1.3 |
| Modified polyacrylic acid (MW 4500)[3] | 3.8 | 1.3 | 4.0 | 3.8 |
| Polyacrylic acid (MW 4500)[4] | 2.0 | 2.3 | 2.7 | 4.1 |
| Co-polymer of maleic acid and olefin (MW 15000)[5] | 4.3 | 0.5 | 2.9 | 1.3 |
| Poly (acrylate/methacrylate) (MW 3500)[6] | 4.0 | 1.0 | 4.4 | 1.8 |

[1]Celquat H-100 ex National Starch and Specialty Chemicals
[2]ex ROHM & HAAS
[3]Norasol 470 ex ROHM & HAAS
[4]Acusol 445ND ex ROHM & HAAS
[5]Acusol 460ND ex ROHM & HAAS
[6]Acusol 480ND ex ROHM & HAAS It is important to note that the high wash temperatures (65° C.) and water hardness (500ppm) conditions used in this example are known to promote scale formation which results in higher spotting or filming scores on glassware.

This example clearly demonstrates the ability of the essential polymers of this invention to deliver glass appearance benefits superior to those of the other polymers used in this example. These prior art materials are claimed by their manufacturers to deliver improved glass appearance (e.g. spotting and film deposition) under the stressful conditions described above. Additionally, as indicated in Table 1, antiscalant polymers are present in the detergent formulation used for these tests. The essential polymers of this invention clearly provide a glassware appearance benefit superior to any that may be provided by the antiscalant polymers.

EXAMPLE 2

This example illustrates the negligible effects of detergent type, water hardness, dishwasher type and wash program, and mode of incorporation on the level of benefits delivered by the essential polymers of this invention added to the dishwashing process.

The results for Product 1 shown in Table 3 were obtained using the Normal program of an Electrolux ESF 675 automatic dishwasher, as described in Example 1.40.0 g ASTM Standard Food Soil was spread on the dishwasher door. Along with the ASTM soil, 10 egg yolk soiled plates and 10 starch soiled plates were placed on the bottom rack of the dishwasher. Water hardness was adjusted to 500 ppm with a Ca:Mg ratio of 4:1. The essential polymer of the invention was dosed into the main wash via the dispenser cup at a level of 0.95 g; or at 0.30 g into the final rinse. 10 washed glasses were visually assessed and scored on the 0 to 5 scale with 0 being clean and 5 completely covered with spots or heavy chalky film, respectively.

The results shown for Product 2 in Table 3 were obtained using the Economy program of a Siemens SE 29290 EU automatic dishwasher. This program comprises a cold prewash, main wash cycle heated to 55° C., intermediate cold rinse, a 70° C. final rinse, and a non-heated drying step. Water hardness was adjusted to either 75 ppm or 300 ppm with a Ca:Mg ratio of 4:1. The soil load and evaluation procedure was identical to that used for Product 1. 1.2 g of polymer was dosed into the main wash with Product 2; or into the final rinse; or divided into 2 equal parts and dosed one part with the detergent via the dispenser cup and the other part into the final rinse.

TABLE 3

Effect of water hardness, mode of incorporation, dishwasher type and wash program

| Portion of the wash program in which the polymer | Product 1 500 ppm water Electrolux, Normal program Glass appearance | | Product 2 75 ppm water Siemens, Economy program Glass appearance | | Product 2 300 ppm water Siemens, Economy program Glass appearance | |
|---|---|---|---|---|---|---|
| was dosed | Spots | Film | Spots | Film | Spots | Film |
| Control (no additive) | 4.1 | 1.2 | 3.5 | 0 | 3.9 | 0.4 |
| Main wash | 1.5 | 0.85 | 1.6 | 0.5 | 1.9 | 0.2 |
| Main wash and Final rinse | | | 1.6 | 0.5 | 1.8 | 1.0 |
| Final rinse | 1.1 | 1.6 | 1.6 | 0.5 | 1.9 | 1.0 |

The experimental data shown in Table 3 indicate that the essential polymers of the invention are capable of effectively reducing spot formation when used with both non-phosphate and phosphate based automatic dishwashing formulations. The data further shows that the essential polymers provide improved glassware appearance over a range of water hardness, mode of incorporation, dishwasher type and wash program.

The spotting and filming characteristics of a given formulation are known to depend upon the machine dishwasher type and even the wash program chosen. The superior performance of the essential polymers of the invention across machine types and wash programs demonstrates the robust nature of its effectiveness. Additionally, as indicated in Table 1, antiscalant polymers are present in both of the detergent formulation used for these tests. The essential polymers of this invention clearly provide a glassware appearance benefit superior to any that may be provided by the antiscalant polymers.

EXAMPLE 3

Example 3 demonstrates the effect of the essential polymers of the invention on glass appearance with and without heavy soil loads being present in the wash.

This set of experiments was carried out in an Electrolux ESF 675 automatic dishwasher using the Normal program. Water hardness was adjusted to 500 ppm with Ca:Mg=4:1. The soil load consisted of 10 egg yolk and 10 starch soiled plates as well as 40.0 g of the ASTM Standard Food Soil. When introduced into the main wash, the essential polymer was dosed together with Product 1 (composition see in Example 1) via the dispenser cup at a level of 0.95 g; or at either 0.15 g or 0.3 g respectively into the final rinse.

TABLE 4

Effect of soils in the wash on glass appearance benefits.

| Portion of the wash program in which the polymer was dosed | No soil in the wash | | Soiled dishware in the wash | |
|---|---|---|---|---|
| | Spots | Film | Spots | Film |
| No additive | 4.0 | 1.8 | 4.0 | 0.8 |
| Main wash (0.95 g) | 2.0 | 1.0 | 0.5 | 0.5 |
| Final rinse (0.15 g) | 1.2 | 0.75 | 1.95 | 1.85 |
| Final rinse (0.3 g) | — | — | 0.75 | 1.5 |

Even though these wash conditions were chosen so as to increase and accelerate spot deposition on the glassware, the data shown in Table 4 demonstrate that the essential polymers of the invention are a very effective ingredients for reducing spotting on the glassware during the wash, regardless of the level of food residues present in the wash liquor.

What is claitned is:

1. A method of reducing spotting and filming on glassware cleaned in an automatic dishwashing machine comprising the steps of:

a) providing a composition having i) an effective amount of a water soluble cationic or amphoteric polymer having at least one cationic monomer unit having a cationic charge over a portion of the pH range of about 2 to about 11 in a wash or rinse cycle and ii) 1 to 90% by weight of a builder; and b) contacting glassware with the composition in an automatic dishwashing machine, wherein the polymer reduces spotting and filming on the glassware wherein the cationic monomer unit is derived from a diallyldimethyl ammonium salt having the formula

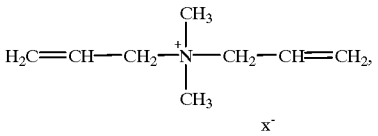

and has the formula

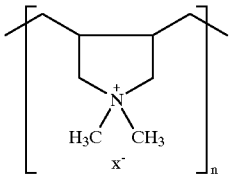

wherein n is 1 to 100,000 and x is a halide selected from the group consisting of chloride, bromide, iodide, hydroxide, phosphate, sulfate, hydrosulfate, ethyl sulfate, methyl sulfate, format and acetate.

2. The method according to claim 1 wherein the polymer is present at a level of 0.1 to 20 wt. % of the total composition.

3. The method according to claim 1 wherein the cationic or amphoteric polymer further comprises a cationic monomer unit which is derived from an ethylenically unsaturated compound as described by formula I

I

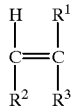

wherein $R^1$ is hydrogen, hydroxyl, or a $C_1$ to $C_{30}$ straight or branched alkyl radical; $R^2$is hydrogen, a $C_1$ to $C_{30}$ straight or branched alkyl, a $C_1$ to $C_{30}$ straight or branched alkyl substituted aryl, aryl substituted $C_1$ to $C_{30}$ straight or branched alkyl radical or a poly oxyalkene condensate of an aliphatic radical, and $R^3$ is a heteroatomic organic radical containing either one or more quaternerized nitrogen atoms or one or more amine groups having a $pK_a$ of about 6 or greater and a positive charge over a portion of the pH interval pH 2 to 11.

4. The method according to claim 1 wherein the cationic polymer further comprises nonionic monomer units and the amphoteric polymer further comprises both nonionic and anionic monomer units which are derived from unsaturated substituted compounds of formula V:

V

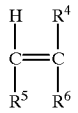

wherein the $R^4$, $R^5$ and $R^6$ are each a hydrogen, a $C_1$–$C_3$ alkyl, a carboxylate group, a carboxylate group substituted with a $C_{1-30}$ linear or branched heteroatomic alkyl or aromatic radical, a heteroatomic radical or a poJyoxyalkelene condensate of an aliphatic radical.

5. The method according to claim 1 wherein the polymer comprises 1 to 100 mole % of a cationic or an amphoteric monomer unit.

6. The method according to claim 1 wherein the polymer further comprises a nonionic monomer unit having a formula

VI

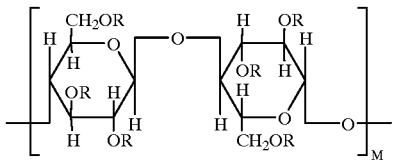

wherein M is 1 to 100,000, R is hydrogen or —(—$CH_2CH_2O$—)$_n$—H and n is 1–15.

7. The method according to claim 1 wherein the cationic polymer is a copolymer of diallyidimethylammonium salt and hydroxyethylcellulose.

* * * * *